United States Patent [19]

Strassner

[11] Patent Number: 4,571,903

[45] Date of Patent: Feb. 25, 1986

[54] AUTOMOBILE DENT PROTECTION SYSTEM

[76] Inventor: Martin F. Strassner, 10401 Balboa Blvd., Granada Hills, Calif. 91344

[21] Appl. No.: 646,648

[22] Filed: Aug. 31, 1984

[51] Int. Cl.[4] ..... E04H 14/00

[52] U.S. Cl. ..... 52/173 R; 49/197; 160/330; 293/128

[58] Field of Search ..... 52/173 R, 29; 49/70, 49/197, 460; 293/128; 160/330; 256/23

[56] References Cited

U.S. PATENT DOCUMENTS

| | | | |
|---|---|---|---|
| 3,610,669 | 10/1971 | Morrissey, Sr. | 293/128 |
| 3,704,037 | 11/1972 | Glassberg | 293/128 |
| 3,738,695 | 6/1973 | McBee | 293/128 |
| 4,010,933 | 3/1977 | Hebda | 160/330 X |
| 4,014,583 | 3/1977 | Forbes | 293/128 |

*Primary Examiner*—Donald G. Kelly
*Assistant Examiner*—Jean LaKemper
*Attorney, Agent, or Firm*—Poms, Smith, Lande & Rose

[57] ABSTRACT

In order to prevent parked automobiles from being dented or scratched when they are parked in a regular parking space in a garage, carport or the like, a pad is suspended from overhead in a location near the car, or between two adjacent cars. The pad may be of substantial extent, such as two feet by five feet, for example, in order to protect all of the areas which might receive small dents from the doors of adjacent cars. The pad is preferably suspended from above the vehicles and is provided with supports such that the pad may be shifted to different stable positions where it is closer to one car or the other, or where it is raised up out of the way to provide additional clearance for other activities.

6 Claims, 4 Drawing Figures

AUTOMOBILE DENT PROTECTION SYSTEM

FIELD OF THE INVENTION

This invention relates to protective devices or assemblies for preventing the denting or damaging of parked cars by the opening of doors of adjacent vehicles.

BACKGROUND OF THE INVENTION

Problems which are widely encountered are that of small dents or "dings" caused by the opening of car doors by persons parked adjacent to one's automobile. Prior arrangements which have been proposed for preventing such denting are shown in U.S. Pat. No. 3,610,669 granted Oct. 5, 1971, and in U.S. Pat. No. 4,014,583, granted Mar. 29, 1977. These patents disclose arrangements of hanging a protective unit from an automobile along the side thereof in order to protect it from impingement by the doors of adjacent parked cars. However, they present the problem that the protective unit must be taken along with the vehicle and installed by the user whenever it is to be placed in service. This is bothersome first in that it requires trunk or other storage space in the car for the protective assembly, and secondly in that it takes time and effort for installation on each occasion when it is to be used.

Accordingly, a principal object of the present invention is to provide a protective arrangement for automobiles to prevent dents from adjacent cars when the vehicle is parked, and more particularly, such an assembly which need not be carried with the car, and requires no time for its installation each time when it is to be used.

SUMMARY OF THE INVENTION

In accordance with the present invention, a protective pad to prevent damage to a parked vehicle from the opening of the doors of adjacent vehicles is suspended from above the car along the side of the car in a garage or a carport, rather than being fixed and mounted on the automobile itself. In addition, arrangements are provided for permitting movement of the protective pad while the pad remains suspended from above.

The suspension may include arrangements for securing the pad either directly or indirectly to the garage door, so that, when the garage door is opened, the pad will be lowered into its protective location, while, when the garage door is closed, the pad is raised, permitting access to the space under it.

Another aspect of the invention involves the use of movable mounting points for ropes supporting the pad so that the pad may be shifted to a stable position close to either one of the two adjacent vehicles, so that it is easier to enter the other vehicle. This arrangement is particularly suitable to a family having two cars which are normally parked side by side in a two-car garage, or for use with assigned spaces in an apartment or office garage.

Other objects, features and advantages of the invention will become apparent from a consideration of the following detailed description and from the accompanying drawings.

DETAILED DESCRIPTION

Figure 1:
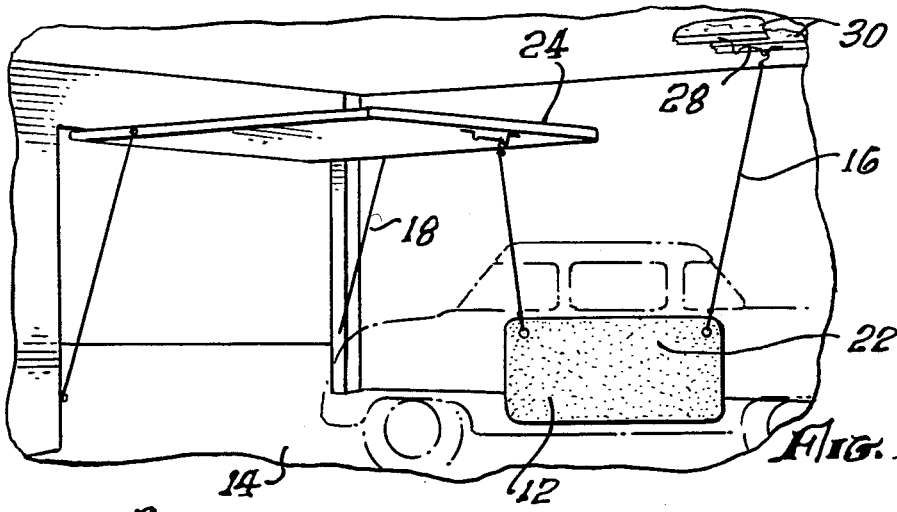
FIG. 1 is a perspective view of a protective pad installation illustrating the principles of the invention, as applied to a two-car garage.
Figure 3:
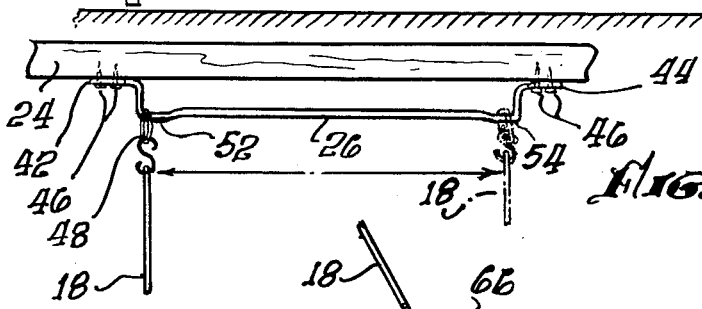
FIG. 3 is an enlarged showing of a bracket which may be employed to support the ends of the mounting ropes in the arrangement of FIGS. 1 and 2.

Referring more particularly to the drawings, FIG. 1 shows a two-car garage with a protective pad 12 mounted in a location about a foot or so above the floor 14 of the garage, from two ropes 16 and 18 which extend through grommet holes 20 and 22 in the pad 12, with the ropes being supported from above the vehicles which are to be parked in the garage. The rope 18 is secured to the door 24, by a bracket 26 as shown in FIG. 3, to be described below. The rope 16 secured to the other end of the pad 12, is suspended from a similar bracket 28 which is mounted on one of the rafters 30 in the garage.

Figure 2:
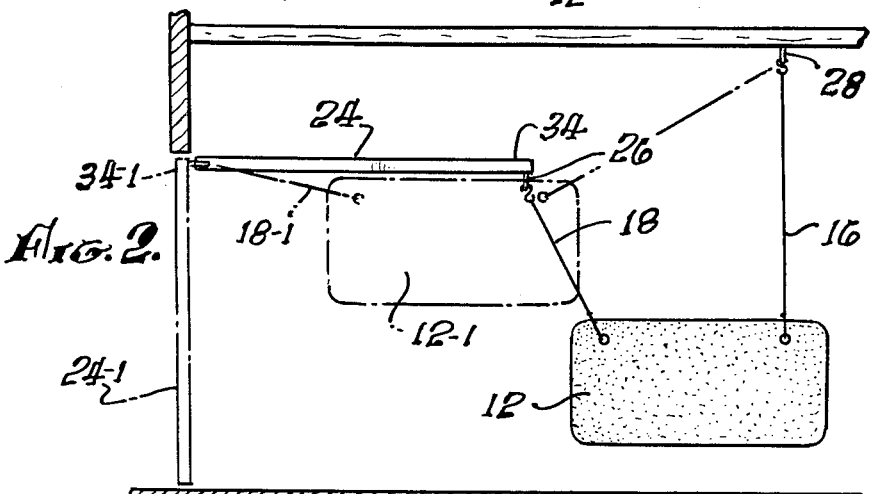
FIG. 2 is a diagram indicating two possible positions of the pad when the garage door is opened or closed.

The diagram of FIG. 2 indicates the movement of the pad 12 as the door is closed. Of course, with the door open as shown in solid lines in FIG. 2, the end 34 of the garage door is well inside the garage. However, when the door shifts to the position shown at 24-1 in FIG. 2, with the upper end of the door 34-1 being in the indicated position. With the rope 18-1 moved to the indicated location, the pad 12-1 is raised up from the floor and into the indicated position. This provides sufficient space for cleaning or moving articles about the garage, as might be desirable when the cars are not there. If desired, pulleys may be provided to extend over the locations where the brackets 26 and 28 are located, so that greater shifting of position in the vertical direction, of the pad 12, may be achieved.

As mentioned hereinabove, there are brackets of the type shown in FIG. 3 at both point 26 and point 28 in FIGS. 1 and 2. Referring more particularly to FIG. 3, the garage door 24 may have the bracket 26 secured to it centrally. Bracket 26 may, for example, be formed from 3/16ths inch thick heavy wire, flattened at its two ends 42 and 44 and provided with drilled holes for receiving the screws 46. A metal ring 48 or pulley may be slidably mounted on the bracket 26, with the rope 18 tied to the ring 48. As mentioned above, a similar installation is located at bracket 28 to which the other rope 16 is secured.

Now, in use, when one of the cars is to be entered, the pad 12 is located adjacent the other car by sliding the ring 48 in one direction along the bracket 26, by applying pressure to the ropes 18. Similarly, when the other car is to be used, the ring 48 may be slid to the other end of bracket 26 to locate the pad adjacent the other vehicle. The bracket 26 may preferably have a total length of $2\frac{1}{2}$ or 3 feet, the usual spacing between vehicles within a two-car garage. The bracket 26 preferably has slight downward bends at points 52 and 54, to provide a relatively stable position for the ring 48 in each of these two locations, despite the upward and downward movement of the garage door 24. Accordingly, when it is desired to have easier access to one of the cars, the pad 12 may be pushed toward the other car by moving the ring 48 along the bracket 26, with similar action being accomplished at the other support point 28.

Figure 4:
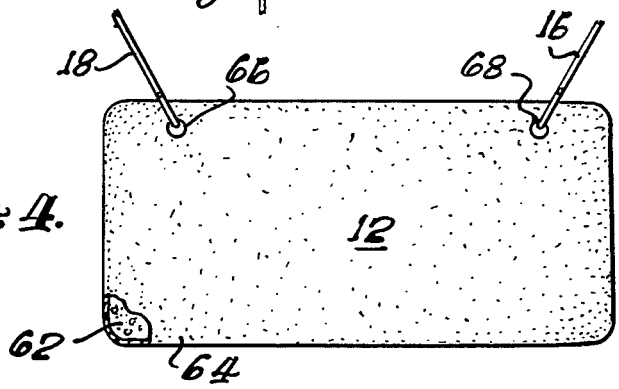
FIG. 4 is an enlarged view of a pad which may be employed in the implementation of the present invention.

FIG. 4 is a slightly enlarged view of the protection pad 12. It includes an inner pad 62 which may, for example, be made of foamed plastic material such as polyurethane, and an outer covering 64 made of some relatively tough plastic sheet material such as a heavy duty vinyl. Two or more large size grommets 66 and 68 extend through the entire pad 12 and provide access for securing the supporting ropes 16 and 18. The pad 12 is two feet high by five feet long, by approximately one inch thick. It is to be understood that these dimensions are merely illustrative, and other dimensions such as one foot by eight feet or three feet by six feet may be employed, depending on the size of the two cars, etc. Smaller pads or protective units may be used when the adjacent car only has one door on each side.

In conclusion, it is to be understood that the foregoing detailed description and the accompanying drawings relate to a specific preferred embodiment illustrating the principles of the invention. Various changes and alternative arrangements may be employed which are within the purview of the principles of the invention. Thus, by way of example, and not of limitation, the pad may be made of other material, such as foam rubber, coarse woven material with an outer covering, or several parallel lengths of rubber hose. In addition, the supporting points for the upper ends of the ropes may be pulled back and forth transversely by mechanical arrangements, rather than being manually slidable on the bracket 26; and the support points 26 and 28 shown in FIGS. 1 and 2 could have fixed pulleys mounted to the garage frame, with ropes passing through the pulleys and secured to the door, so that the pad 12 would be raised vertically by a substantial distance toward the ceiling of the carport or garage. Accordingly, the present invention is not limited to that precisely as shown in the drawings as described in detail hereinabove.

What is claimed is:

1. An assembly for protecting cars against dents from doors of adjacent cars, comprising:

a pad having an extent in the order of two feet high by five feet long for the protection of the side of a car from the opening of doors of adjacent parked cars;

means for hanging said pad from above the cars to be protected in a garage, carport or the like, in a location where said pad provides optimum protection from adjacent vehicles;

means for shifting said pad from one location to another while said pad remains suspended from said hanging means; and said hanging means including at least two ropes for supporting said pad, and at least one of said ropes is coupled to the garage door, whereby said pad is moved in its location as the garage door is raised and lowered.

2. An assembly as defined in claim 1 further including bracket means having a substantial lateral extent for supporting one end of one of said ropes, whereby the rope may be shifted laterally along the bracket, to shift the position of the pad closer to either of the two cars.

3. An assembly for protecting cars against dents from doors of adjacent cars when said cars are parked in a garage, comprising:

means including a resilient pad for the protection of the side of a car from the opening of doors of adjacent parked cars;

means for hanging said pad from above the cars to be protected in a garage, carport, or the like in a location where said pad provides optimum protection from adjacent vehicles; and means for supporting said pad in at least two stable spaced locations while said pad remains suspended from said hanging means;

said hanging means including at least two ropes for supporting said pad; and means for moving said pad in its location as the garage door is raised and lowered, said moving means including means for coupling at least one of said ropes to the garage door.

4. An assembly as defined in claim 3 further including bracket means having a substantial lateral extent for supporting one end of one of said ropes, whereby the rope may be shifted laterally along the bracket, to shift the position of the pad closer to either of the two cars.

5. An assembly for protecting cars against dents from doors of adjacent cars, comprising:

means including a resilient pad for the protection of the side of a car from the opening of doors of adjacent parked cars;

means for hanging said pad from above the cars to be protected in a garage, carport, and the like in a location where said pad provides optimum protection from adjacent vehicles, and said hanging means including at least two ropes for supporting said pad, and means for coupling at least one of said ropes to the garage door to move said pad in its location as the garage door is raised and lowered.

6. An assembly as defined in claim 5 further including bracket means having a substantial lateral extent for supporting one end of one of said ropes, whereby the rope may be shifted laterally along the bracket, to shift the position of the pad closer to either of the two cars.

* * * * *